United States Patent [19]

Field et al.

[11] Patent Number: 4,679,271

[45] Date of Patent: Jul. 14, 1987

[54] AUTOMATIC TOOL FORCE COMPENSATOR FOR A SURFACE MAINTENANCE MACHINE

[75] Inventors: Bruce F. Field, Minneapolis; Joseph G. Kasper, Gold Valley, both of Minn.

[73] Assignee: Tennant Company, Minneapolis, Minn.

[21] Appl. No.: 839,877

[22] Filed: Mar. 14, 1986

[51] Int. Cl.[4] ..... A47L 11/18; A47L 11/20

[52] U.S. Cl. ..... 15/49 C; 15/50 C; 15/320; 15/384; 15/389; 51/176

[58] Field of Search ..... 15/49 R, 49 C, 50 R, 15/50 C, 50 A, 51, 52, 98, 320, 340, 383, 384, 385, 389; 51/174–177; 299/39, 41

[56] References Cited

U.S. PATENT DOCUMENTS 3,531,078 9/1982 Sternberg .
3,531,249 6/1985 Sternberg .
3,702,488 11/1972 Kasper .
4,218,798 8/1980 Block .

FOREIGN PATENT DOCUMENTS 0173394 3/1986 European Pat. Off. ..... 15/49 R

*Primary Examiner*—Edward L. Roberts
*Attorney, Agent, or Firm*—Kinzer, Plyer, Dorn & McEachran

[57] ABSTRACT

There is disclosed an improvement in a surface maintenance machine whereby means are provided for automatically maintaining a desired normal force by a maintenance tool against a surface being maintained, although there may be undulations in the surface, variations in the condition of the surface and changes in the tool caused by wear. Normal force is applied to the tool by gravity and an actuator, both acting through a load cell which senses their algebraic sum, compares this with a preset desired force and operates the actuator as needed to maintain the force at or near the pre-set level. Further, the load on the motor or motors driving the tool is sensed and compared against high and low reference points. If drive motor load is outside of the reference limits a signal is provided which causes a decrease or increase in the normal force to maintain the motor load within limits.

9 Claims, 4 Drawing Figures

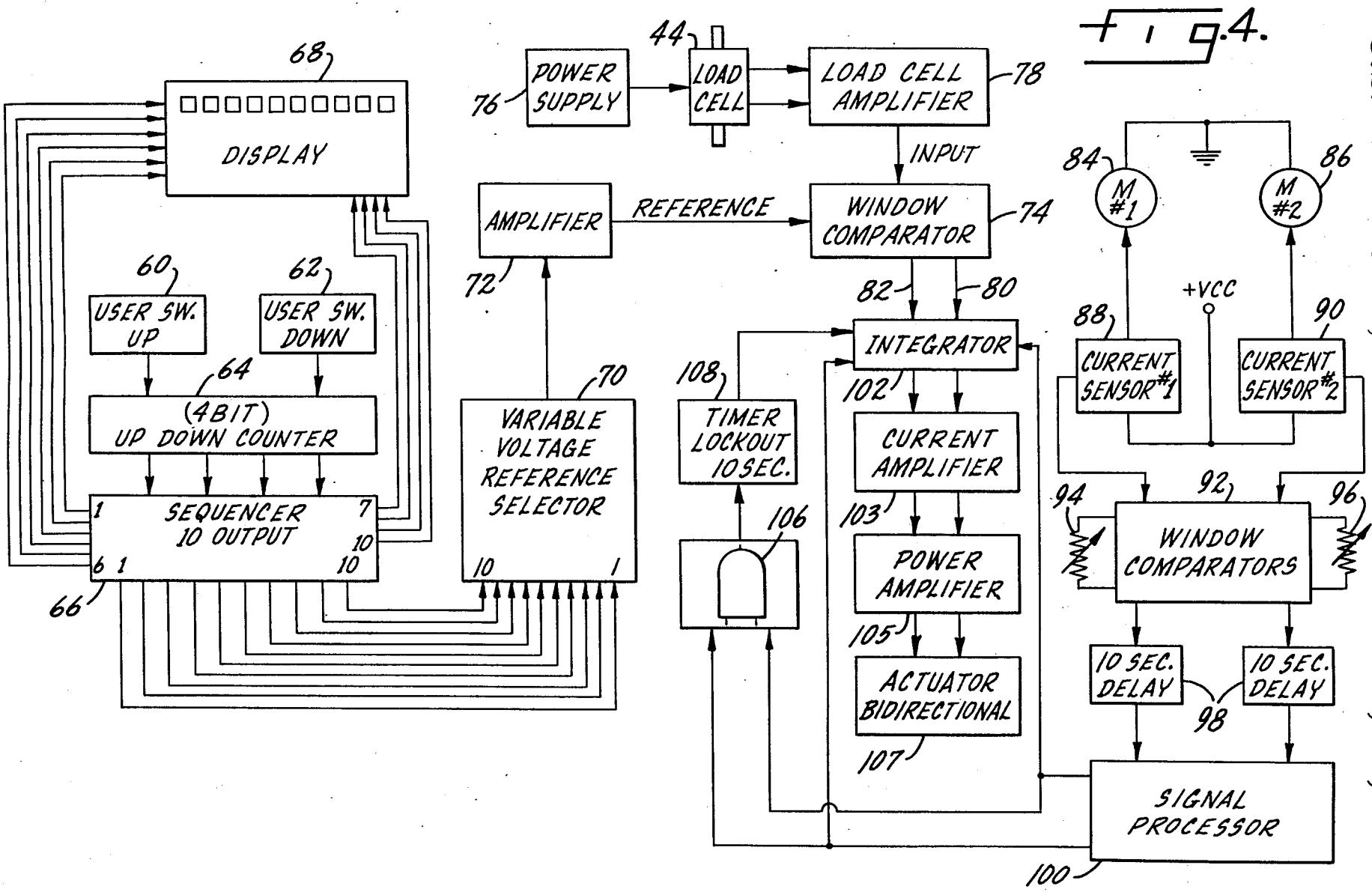
FIG. 4.
M #2
M #1
CURRENT SENSOR #2
CURRENT SENSOR #1
+VCC
WINDOW COMPARATORS
10 SEC. DELAY
10 SEC. DELAY
SIGNAL PROCESSOR
LOAD CELL AMPLIFIER
INPUT
WINDOW COMPARATOR
INTEGRATOR
CURRENT AMPLIFIER
POWER AMPLIFIER
ACTUATOR BIDIRECTIONAL
LOAD CELL
TIMER LOCKOUT 10SEC.
POWER SUPPLY
REFERENCE
AMPLIFIER
VARIABLE VOLTAGE REFERENCE SELECTOR
DISPLAY
USER SW. DOWN
USER SW. UP
(4BIT) UP DOWN COUNTER
SEQUENCER 10 OUTPUT

AUTOMATIC TOOL FORCE COMPENSATOR FOR A SURFACE MAINTENANCE MACHINE

SUMMARY OF THE INVENTION

The present invention relates to an automatic tool force compensator for a surface maintenance machine and has particular application to an electric control which raises and lowers the surface maintenance tools in response to changes in the elevation or condition of the surface being maintained or changes in the tool due to wear.

A primary purpose is an automatic tool force compensator used to maintain a predetermined force on a surface being maintained which compensates for variations in elevation of the surface.

Another purpose is an automatic tool force compensator that prevents excessive force from being applied to a surface by a maintenance tool, thereby reducing damage and wear on the tool and extending its life.

Another purpose is an automatic tool force compensator used to maintain a predetermined force on a surface being maintained which compensates for changes in the tool due to wear.

Another purpose is an automatic tool force compensator which senses changes in condition of the surface being maintained by monitoring the load on the tool drive motors and adjusts the applied tool force on the surface to maintain the motor load within set limits.

Another purpose is an automatic tool force compensator which utilizes a load cell to measure force applied by a maintenance tool on a surface being maintained and causes it to be varied as necessary to maintain it within desired limits.

Another purpose is an automatic tool force compensator which utilizes an actuator to raise and lower a surface maintenance tool and thereby vary the force which the tool applies on the surface being maintained to keep the force within set limits.

Another purpose is an automatic tool force compensator which prevents opposite direction tool movement signals from being simultaneously applied to the tool actuator.

Another purpose is an automatic tool force compensator of the type described which is simply constructed and reliably operable.

Other purposes will appear in the ensuing specification, drawings and claims.

BRIEF DESCRIPTION OF THE DRAWINGS

The invention is illustrated diagrammatically in the following drawings wherein:

FIG. 4 is a block diagram illustrating the control circuit used to maintain brush position on the floor.

DESCRIPTION OF THE PREFERRED EMBODIMENT

Figure 1:
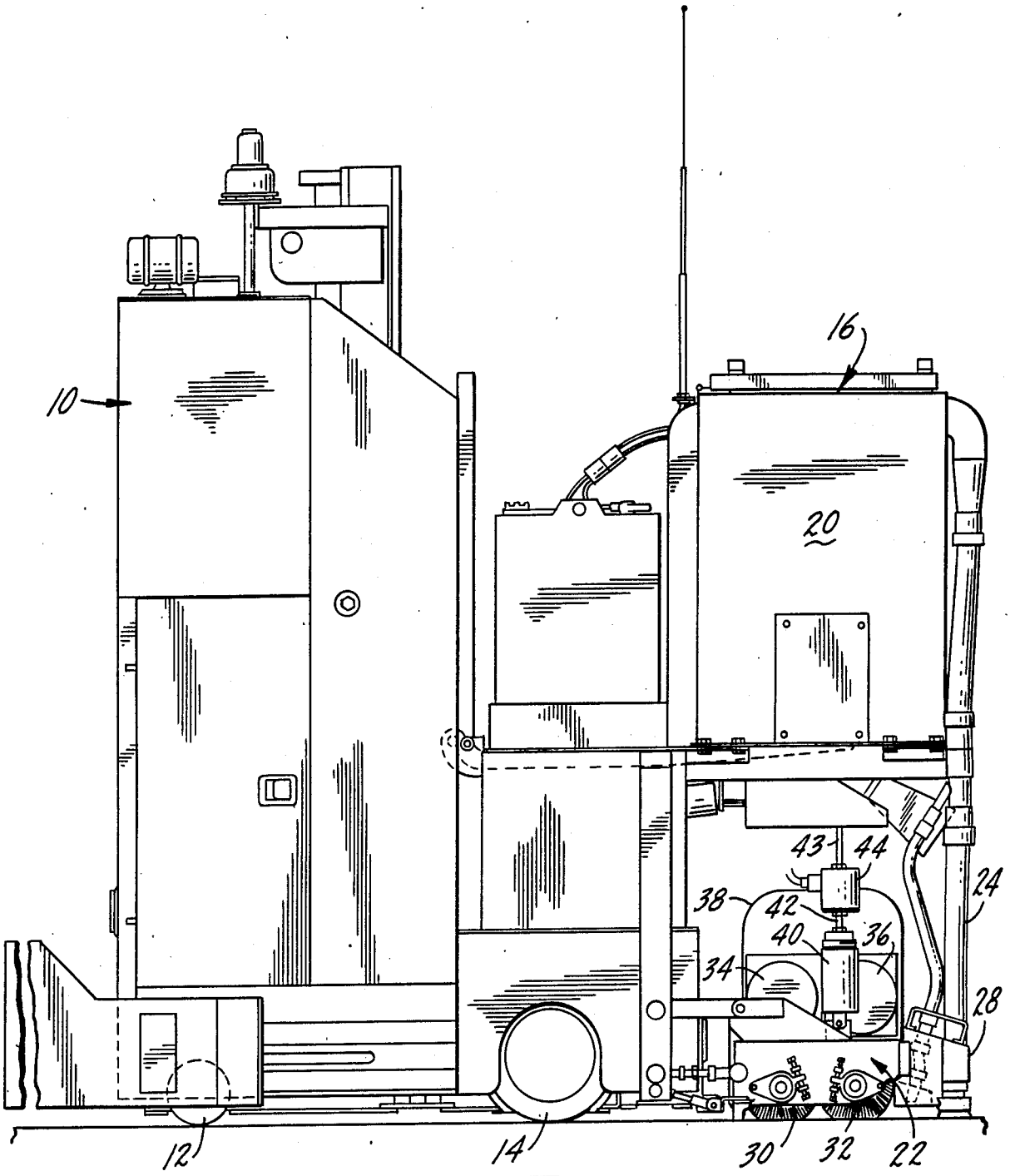
FIG. 1 is a side view of a vehicle mounting floor maintaining scrubbing brushes.

The present invention is directed to surface maintenance machines and more specifically to an automatic tool force compensator for such machines. The invention will be specifically described in connection with a floor scrubbing machine, however, it should be recognized that the invention has substantially wider application. The compensating means disclosed herein is also applicable to other brush type machines such as sweepers, as well as to other types of floor tools or surface maintenance tools such as pads for polishing, cleaning or burnishing; sanding drums or belts for removing worn floor coatings; and scraping tools for removing packed soilage or worn coatings. Further, although the machine will be described in connection with treating a floor, other surfaces such as sidewalks, parking lots and streets could also be treated by machines utilizing the present invention.

The tool force compensating means disclosed is directed to controlling the force applied by the tool to the surface being treated whether it be a brush to a floor or some other type of tool to some other type of surface. Such control is required in order to attain the maximum efficiency in treating the surface. Specifically, in the case of a brush, it is desired to maintain, to the extent practical, a certain pattern of brush contact with the floor so that the operator is aware of the degree to which the brush is applying its rotating motion to the floor. The applied pattern is a function of the applied force and the stiffness of the brush bristles. The bristles become stiffer as they wear shorter, so the pattern will become narrower as the brush wears even if constant force is applied at all times. Thus, a force wear compensator is a more accurate description of the invention than a pattern control, although clearly the pattern of the application tool is important in terms of operator control.

In some applications the force that is sensed is actually the weight of the tool. This is particularly true with a scrubbing brush. However, in other applications it may be required that a downward force, greater than the weight of the tool, be exerted on the underlying surface. This would particularly be the case in a sander or scarifying tool.

The invention not only provides a means for automatically compensating for tool wear, but it also compensates for varying elevations in the surface being treated. Prior art machines with fixed tools have very little capacity to conform to floor variations. A sweeper or scrubber using a fixed brush mounting has only the resilience of the brush bristles where they are bent by contact with the floor to provide a measure of floor conformance. Other tools, such as scarifiers, when rigidly mounted, may have no ability at all to conform to floor irregularities. However, undulations and disparities are common in floors and other surfaces and a machine in which the tool can move up and down and follow such variations is far more efficient and provides a more uniform maintenance function than a tool which does not have this ability.

The drive motors for the brushes disclosed herein are electric. The invention is equally applicable to hydraulic motors which are common in floor sweepers. Overload in an electric motor is sensed as excessive current, whereas, overload in a hydraulic motor will create excessive pressure differential across the motor. Either type of load can be sensed and a signal provided to indicate that in fact there is an overload on the motor. Such motor overload can be caused not only by excessive force applied to the surface being treated, but also by changes in floor conditions. For example, a scrubber might hit a patch of sticky material such as molasses or a section of rough concrete in an otherwise smooth floor. A sweeper in a parking lot might hit a stretch of deep sand. The invention as described herein provides means for sensing such an overloaded condition on the tool drive motors as well as for sensing tool wear.

Considering the specification application of a scrubber, a certain portion of the weight of the brushes and the supporting mechanism, including the brush drive motors, is actually supported on the floor. The proper brush pattern or area of contact of the brushes on the floor is maintained by sensing the weight of the brushes and supporting apparatus which is carried by the floor and when that weight changes, the position of the brushes is adjusted to restore the floor supported weight to its original value. Thus, the position of the brushes is adjusted by the weight of the brushes being carried by the floor so as to maintain a predetermined area of contact by the brushes on the floor, which in turn insures that the brushes are being properly utilized to scrub or sweep the floor.

Figure 2:
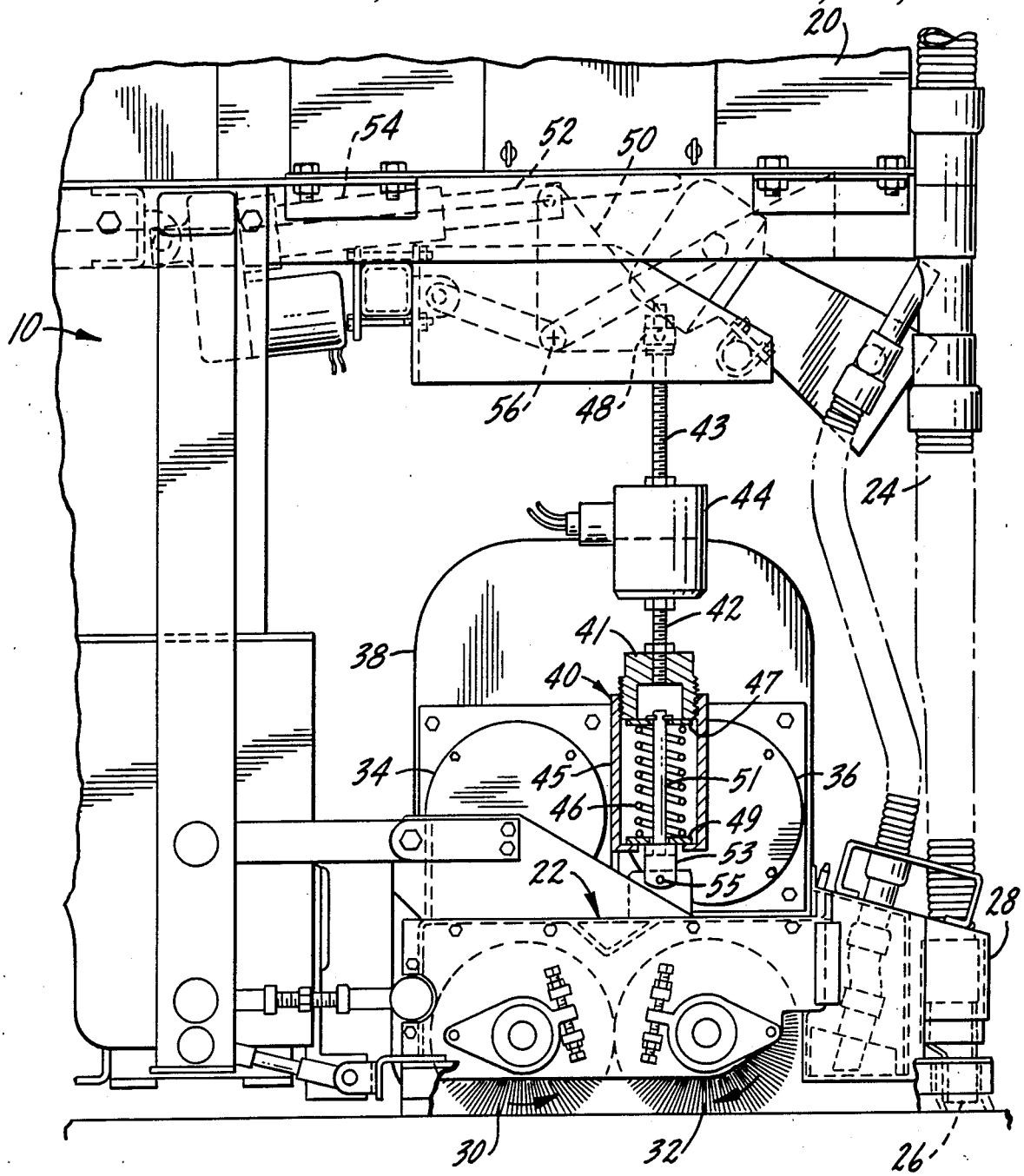
FIG. 2 is an enlarged side view of the brush supporting mechanism including the means for raising and lowering the brushes.
Figure 3:
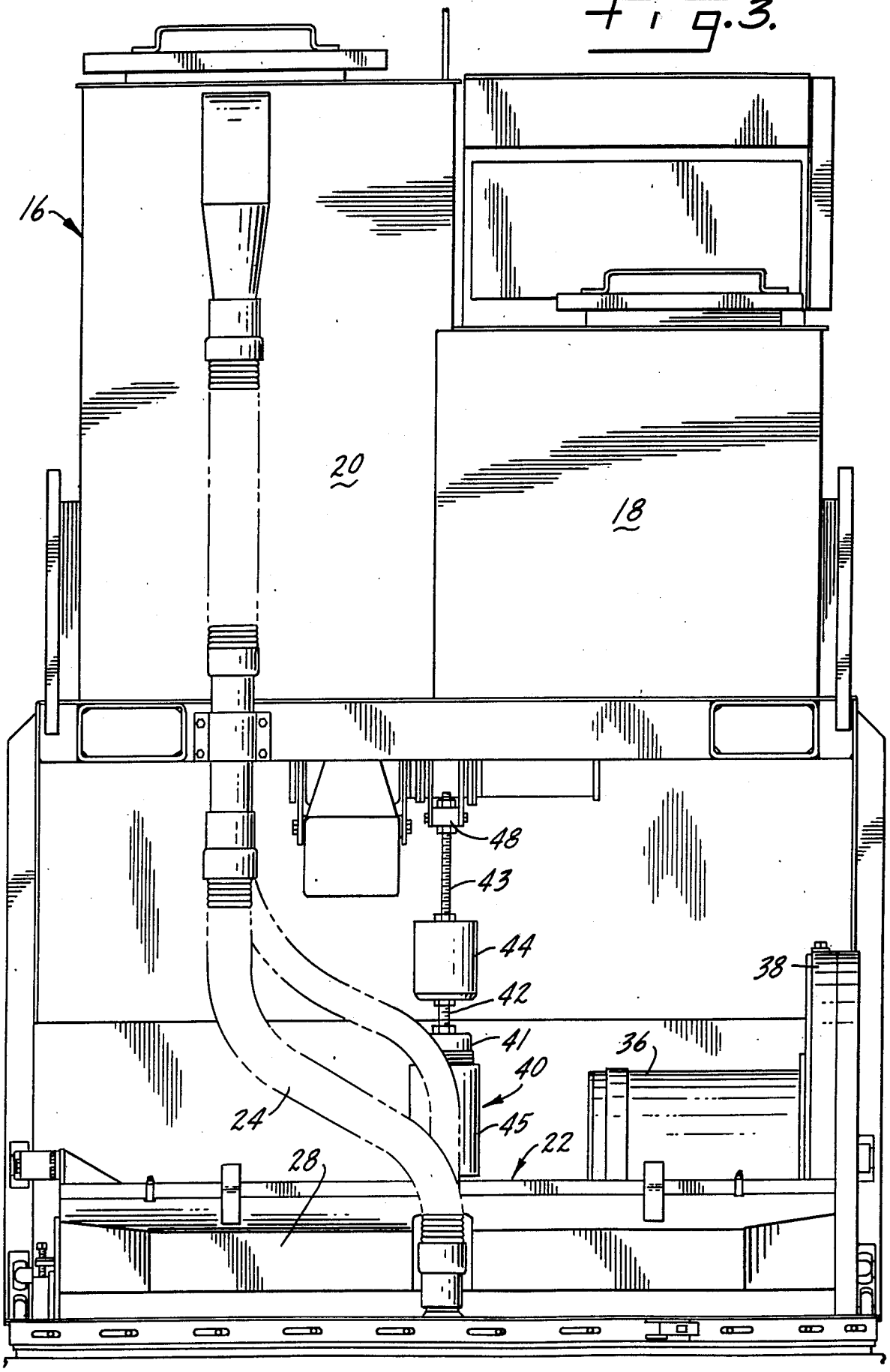
FIG. 3 is an end view of the brush mechanism of FIG. 1, on an enlarged scale.

In FIGS. 1, 2 and 3, a vehicle is indicated generally at 10 and may have support wheels 12 and 14. The vehicle may be of the type known as an automatic guided vehicle in that it follows a cable buried in the floor, but, as indicated above, the invention should not be limited to any particular type of vehicle. In this case the vehicle is a forklift truck and the scrubbing apparatus is mounted thereon and indicated generally at 16.

The scrubbing apparatus includes a solution tank 18, a recovery tank 20 and a scrub head assembly 22. In a manner well known in the art, the solution is applied to the floor from tank 18 and after the brushes in the scrub head have scrubbed the floor, the solution is sucked up by a vacuum hose 24 whose nozzle 26 is positioned in a vacuum squeegee assembly 28. The solution from the squeegee and the vacuum hose is passed to the recovery tank.

The scrub head assembly, which is illustrated in more detail in FIGS. 2 and 3, includes a pair of counterrotating brushes 30 and 32 which are driven by a pair of brush drive motors 34 and 36. An enclosed chain drive is indicated at 38 and it reduces motor speed down to a more appropriate brush speed.

The scrub head assembly 22 is supported by spring-loaded linkage 40, threaded rod 42, load cell 44 and threaded rod 43, which is pivotally connected at 48 to bell crank 50, the opposite end of which is pivotally connected to outwardly extending rod 52 of an electric actuator 54. Linkage 40 includes a collar 41 connected to a sleeve 45 which together enclose a spring 46. It is in a free state between plates 47 and 49 which slide freely on rod 51. This is attached to the scrub head by clevis 53 and pin 55. Either a push or a pull by actuator 54 will compress spring 46 and cause it to exert a downward or upward force on the scrub head. This arrangement also allows the scrub head to move up and down if it encounters irregularities in the floor because spring 46 will yield resiliently.

Inward or outward extension or movement of rod 52 relative to the actuator 54 causes the bell crank to pivot about point 56 and thus raise or lower threaded rod 43 and hence scrub head assembly 22. The position of the scrub head assembly relative to the floor, and thus the position and force of the brushes on the floor, is controlled by the actuator. The load carried by threaded rod 42 which supports the scrub head assembly is measured by load cell 44 and since the total weight of the scrub head assembly is known, as is the applied force from spring 46, the load cell effectively provides an output signal which is indicative of the force of the scrub head assembly applied to the surface which it is maintaining.

In FIG. 4, a block diagram of the control circuit, user "up" and "down" switches are indicated at 60 and 62 and are available for the operator to initially set the brush application force or the area of contact between the brush and the floor. Each of the switches is connected to a four-bit up-down counter 64 which in turn is connected to a ten output sequencer 66. Sequencer 66 is in circuit with a display 68 which provides an indication of the brush force determined by the operator's use of the up-down switches. The operator, by operating the switches in a conventional manner, may change the set brush force and this will be shown in the display. Although ten positions of the brush are indicated, the invention should not be so limited and the desired brush force and the degree of adjustment thereof will depend upon the size of the machine and the particular type of maintenance action—scrubbing, sweeping, burnishing, polishing or whatever.

The output from sequencer 66, which will be a digital representation of one of ten possible brush force applications, is connected to a variable voltage reference selector 70 which provides an analog output voltage representative of the particular brush force selected. The output from selector 70 is connected to an amplifier 72 which then provides a reference voltage level to a window comparator 74.

A power supply is indicated at 76 and is connected to load cell 44, with the output of the load cell being connected to an amplifier 78, Amplifier 78 provides an analog voltage representative of the force applied through the load cell and this analog voltage will be compared with the reference voltage as set by the operator with up-down switches 60 and 62. Window comparator 74 will provide a signal to either raise or lower the scrub head assembly, depending upon whether or not the actual brush force is above or below the window determined by the reference voltage. The outputs of the comparator for up and down movement are indicated on lines 80 and 82.

In addition to sensing the force of the scrub head assembly which is applied to the surface being maintained, the present invention provides a method for sensing the current in the brush drive motors and controlling it within preset limits. The drive motors for the brushes are indicated at 84 and 86 and each drive motor has a current sensor indicated at 88 and 90, respectively, associated therewith. The two current sensors are connected to window comparators 92, with the window of current being compared having been selected by a high current limit resistor 94 and a low current limit resistor 96. Thus, the current drawn by each motor is compared with the reference high and low current levels as determined by the above-designated resistors and if the current drawn by either motor is outside of the window, there will be a signal from comparators 92 to ten-second delay circuits 98. The delay circuits prevent transient overloads from causing a false indication that motor current is outside of the set limits. The outputs of delay circuits 98 are connected to a signal processor 100 which is essentially an amplifier and will provide an amplified output of the signal resulting from the comparison of reference load current vs. actual load current.

The outputs from the signal processor are connected to an integrator 102 which also receives the two outputs from window comparator 74. Integrator 102 is connected to a current amplifier 103 which is connected to a power amplifier 105 which in turn is connected to a bidirectional actuator 107 which raises and lowers the scrub head assembly. Thus, integrator 102 receives a signal from comparator 74 to either raise or lower the scrub head assembly based on a comparison of the force of the brushes being applied to the floor or a signal to either raise or lower the scrub head assembly based on a comparison of brush motor load current vs. a reference current.

The output from signal processor 100 is also connected to an OR gate 106 which has its output connected to a ten-second timer 108. Timer 108 is connected to integrator 102.

The combination of OR gate 106 and timer 108 provides a signal to the integrator which prevents the integrator from functioning in response to the signal from comparator 74 for a period of ten seconds after the integrator has received a command from signal processor 100 to raise or lower the brushes. Without such a lockout, the signals from the two comparators could direct the scrub head assembly actuator to move the brushes in contrary directions. If an overload is sensed on the brush motors, the brushes will be raised and timer 108 will not permit a signal from window comparator 74 to lower the brushes for a period of ten seconds.

There are conditions which are encountered during the maintenance of floors, for example, if the brushes encounter a sticky substance on the floor, which may cause the brush drive motors to draw more current, as the brushes have an increased load, but this condition has nothing to do with brush wear. Thus, the brushes may have to be raised when such a condition is encountered, but this in turn does not affect wear of the brush. Thus, the motor side of the control may cause the brush to be raised, whereas, the wear side would say that is an incorrect movement. It is for this reason that OR gate 106 and timer 108 lock out any signal from comparator 74 for a period of ten seconds.

Low motor drive current can, however, be an indication that the brushes are not adequately treating a floor surface. In this instance the sensing of motor current will supplement the signal from comparator 74 indicating that the brushes should be lowered.

Whereas the preferred form of the invention has been shown and described herein, it should be realized that there may be many modifications, substitutions and alterations thereto.

The embodiments of the invention in which an exclusive property or privilege is claimed are defined as follows:

1. An automatic tool force compensator for a surface maintenance machine including, means for raising and lowering surface maintenance tools, means for setting a degree of tool application force that it is desired to apply to a surface and for providing an electrical signal representative thereof, means for measuring the actual degree of tool application force applied to the surface and for providing an electrical signal representative thereof, means for comparing said electrical signals and for operating said means for raising and lowering the surface maintenance tools in accordance therewith to provide the desired degree of tool application force tool drive means, means for sensing load on the tool drive means and for providing an electrical signal representative thereof, and means for comparing the tool drive means load signal with a reference, with the output of said means for comparing the tool drive means signal with a reference being connected to and providing an operating signal for said means for raising and lowering the surface maintenance tools.

2. The tool force compensator of claim 1 further characterized in that the means for measuring the actual degree of tool application force include means for measuring the weight of the tools on the surface.

3. The tool force compensator of claim 2 further characterized in that the means for measuring the actual degree of tool force application includes a load cell.

4. The tool force compensator of claim 1 further characterized by and including integrating means connected to said means for comparing said electrical signals and said means for comparing the tool drive motor load signal with a reference, with said integrating means being connected to said means for raising and lowering the surface maintenance tools and preventing a signal from one of said comparison means from effecting a change in tool position while the other is causing a change in the tool position.

5. An automatic tool force compensator for a surface maintenance machine including, means for raising and lowering surface maintenance tools, means for setting a degree of tool application force that it is desired to apply to a surface and for providing an electrical signal representative thereof, means for measuring the force applied by the tools to the surface and for providing an electrical signal representative thereof, first comparison means for comparing said electrical signals, means for sensing load on the tool drive means, second comparison means for comparing the tool drive means load with a reference and means for providing an electrical signal representative thereof, and means for combining the signals from said first and second comparison means and providing a drive signal for said means for raising and lowering the surface maintenance tools.

6. The tool force compensator of claim 5 further characterized by and including means for preventing a signal from said first comparison means from providing a signal to said means for raising and lowering the surface maintenance tools during the time that said means for raising and lowering is receiving a drive signal from said second comparison means.

7. The tool force compensator of claim 6 further characterized in that said means for preventing a signal from said first comparison means includes a timer for preventing a signal from said first comparison means to said means for raising and lowering for a predetermined time interval after a drive signal from said second comparison means.

8. The tool force compensator of claim 5 further characterized in that said second comparison means includes a high load reference and a low load reference, with the electrical signal output from said second comparison means being effective to either raise or lower the surface maintenance tools in response to said comparison.

9. The automatic tool force compensator of claim 5 further characterized in that the means for measuring the force applied by the tools to the surface includes a load cell.

* * * * *